US005226970A

United States Patent [19]

Barnett et al.

[11] Patent Number: 5,226,970

[45] Date of Patent: Jul. 13, 1993

[54] ELECTRICAL TRANSFORMER REMANUFACTURING PROCESS FOR REMOVAL OF CONTAMINANTS

[75] Inventors: David A. Barnett, Odenville, Ala.; John R. Daniels, Sr., Cortland, N.Y.

[73] Assignee: General Signal Corporation, Stamford, Conn.

[21] Appl. No.: 694,531

[22] Filed: May 1, 1991

[51] Int. Cl.[5] ..... B08B 3/04

[52] U.S. Cl. ..... 134/14; 134/42; 29/402.04; 29/602.1

[58] Field of Search ..... 134/14, 42; 29/402.04, 29/602.1

[56] References Cited

U.S. PATENT DOCUMENTS 4,425,949 1/1984 Rowe, Jr. ..... 141/1

4,744,905 5/1988 Atwood ..... 134/12

*Primary Examiner*—Theodore Morris

*Assistant Examiner*—Zeinab El-Arini

*Attorney, Agent, or Firm*—Robert R. Hubbard; John F. Ohlandt

[57] ABSTRACT

Process for the remanufacture of transformers of the type having a coil/core assembly immersed in a tank of mineral oil. Contaminants such as water, air and dirt are removed from the coil/core assembly by means of a hot mineral oil bath which is maintained in a temperature range between the boiling point of water and the boiling point of the mineral oil, typically 212° F. to 295° F.

4 Claims, 4 Drawing Sheets

ELECTRICAL TRANSFORMER REMANUFACTURING PROCESS FOR REMOVAL OF CONTAMINANTS

BACKGROUND OF INVENTION

This invention relates to a process for the remanufacture of electrical transformers and, in particular, to a novel and improved process which economically and quickly removes water and other contaminants such as acid, sludge, dirt and the like from the transformer coil/core assembly without material damage to the transformer insulation.

Electrical power and distribution transformers are commonly used in an oil-filled tank or vessel. The filler oil acts as an insulator and coolant to keep the transformer coil/core assembly operating at peak efficiency. Over time the dielectric properties of the oil can deteriorate and substantially reduce the efficiency and operating safety of the transformer. Contaminants such as, water, dirt, acid and air can enter a transformer tank during normal usage and degrade the oil and coil/core assembly. As a result, these transformers must be subjected to a remanufacturing process from time to time to restore their efficiency and operating safety.

According to one known remanufacturing process, water is removed by a hot air drying procedure that involves baking the transformer coil/core assembly in a oven at 275° F. for eight to ten hours. This process has several disadvantages. First, it is highly energy intensive. Second, the number of units that can be treated in a single batch is limited by the size of the oven thereby putting extreme limitations on production capacity as well as ruling out almost completely "same day service." Third, the hot air drying process makes the transformer paper insulation (kraft paper) brittle which severely limits the longevity of the transformer coil/core assembly. Fourth, an undesirable bi-product of the baking process is oil smoke (due to the transformer oil) which causes environmental concerns. Fifth, contaminants such as dirt and sludge are baked into the coil/core assembly and remain there after the assembly is reinserted into the transformer tank and reoiled. Sixth, should there be a delay between removal from the oven and the reoiling process, atmospheric water and air can be reabsorbed by the assembly. Despite all these disadvantages, the hot air drying procedure is an industry-wide accepted method and has been so for many years.

Another known process described in U.S. Pat. No. 4,425,949 acts to remove from a transformer contaminants such as polychlorinated biphenyls and diphenyls (PCB's), water and air. This process employs so-called "substitute oils" that react with the PCB's to form an azeotrope. According to the process, a closed system is established in which the transformer tank is connected to equipment which first evacuates the tank and then flushes the tank and the transformer coil/core assembly with a substitute oil vapor. The exiting vapor is then processed to separate the contaminants from the substitute oil which is then reused. Optionally, the transformer can be subjected after the vapor flush to a hot liquid flush for the purpose of rinsing. However, the disclosed equipment is rather elaborate and expensive and is capable of processing only one transformer at a time. More importantly, the substitute oils disclosed in the patent (methylene chloride, carbon tetrachloride, chloroform, trichloroethylene, perchloroethylene, bromochloromethylene and FREON 111 and FREON 113 (1, 1, 2-trichloro-1, 2, 2-trifluoroethane) are rather hazardous substances which are harmful to the personnel who must handle the substances as well as to the environment.

BRIEF SUMMARY OF THE INVENTION

An object of this invention is to provide a novel and improved process for the remanufacture of electrical transformers in which contaminants such as water are economically and quickly removed from the coil/core assembly.

Another object is to provide a novel and improved process in which contaminants are removed from a transformer coil/core assembly without material damage to the transformer insulation paper.

Still another object of the present invention is to provide a novel and improved process for the removal of contaminants from a transformer coil/core assembly without the use of either hot air drying or toxic or hazardous substances.

Yet another object of the present invention is to provide a novel and improved process for remanufacture of electrical transformers which effectively and rapidly removes water, acid, sludge and dirt from the transformer coil/core assembly in an economical and energy efficient manner.

The invention is embodied in a process for the remanufacture of an electrical transformer which has a coil/core assembly immersed in transformer mineral oil in a tank. The coil/core assembly contains contaminants which include moisture, air and dirt. In accordance with the process, the assembly is removed from the tank and thereafter immersed in a bath of transformer mineral oil at a temperature in the range of 212° F. to 295° F. for a process time adequate to expunge the contaminants from the assembly. The assembly is then removed from the bath and installed in a tank. The tank is then filled with fresh mineral oil under vacuum conditions.

We have found that the process time of immersion in the oil bath is relatively short, say about ten minutes, for a 10–15 KVA transformer at a bath temperature of 250° F. as compared to a resident time of eight to ten hours in the oven for the hot air drying procedure.

BRIEF DESCRIPTION OF THE DRAWINGS

In the drawings like reference characters denote like elements of structure in the various figures.

DESCRIPTION OF PREFERRED EMBODIMENT

In the process embodying the invention, electrical transformers which have deteriorated in operating efficiency are remanufactured or refurbished to an acceptable operating efficiency and then restored to the stream of commerce. These transformers have a coil/-core assembly which is immersed in a tank of mineral oil for insulative and cooling purposes. In usage and over time the dielectric properties of the oil deteriorate and substantially reduce the operating efficiency and safety of the transformer. Contaminants such as water, dirt, acid and air can enter the transformer tank and degrade the oil and the operation of the coil/core assembly.

Figure 6:
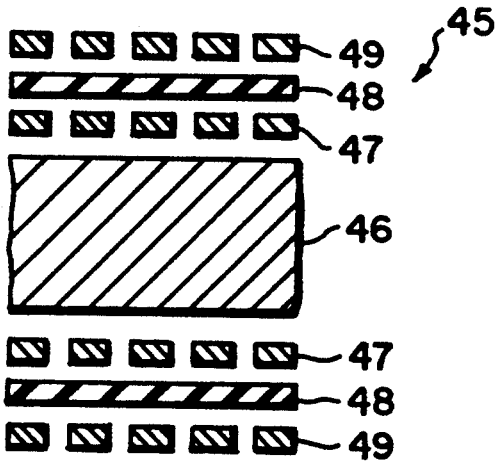
FIG. 6 is a cross-sectional view of a coil/core assembly of an electrical transformer.

A typical coil/core assembly 45 is shown in partial cross-section in FIG. 6. The coil/core assembly 45 includes a core leg 46 about which are wound two layers of coil turns 47 and 49. Sandwiched between the turns 47 and 49 is a layer of insulation 48. The transformer core is metallic material that exhibits magnetic characteristics such as, grain oriented silicon steel, the coil turns are conductive metal such as copper and the insulative layer is kraft paper. The spacing between the coil layers and the kraft paper in FIG. 6 is for illustrative purposes only. It will be appreciated by those skilled in the art that in an actual transformer assembly there is no such spacing. Indeed, after winding of the coil turns and kraft paper, the entire assembly is cured to allow the thermal epoxy of the kraft paper to set and bond the paper to the coil turn layers.

Figure 1:
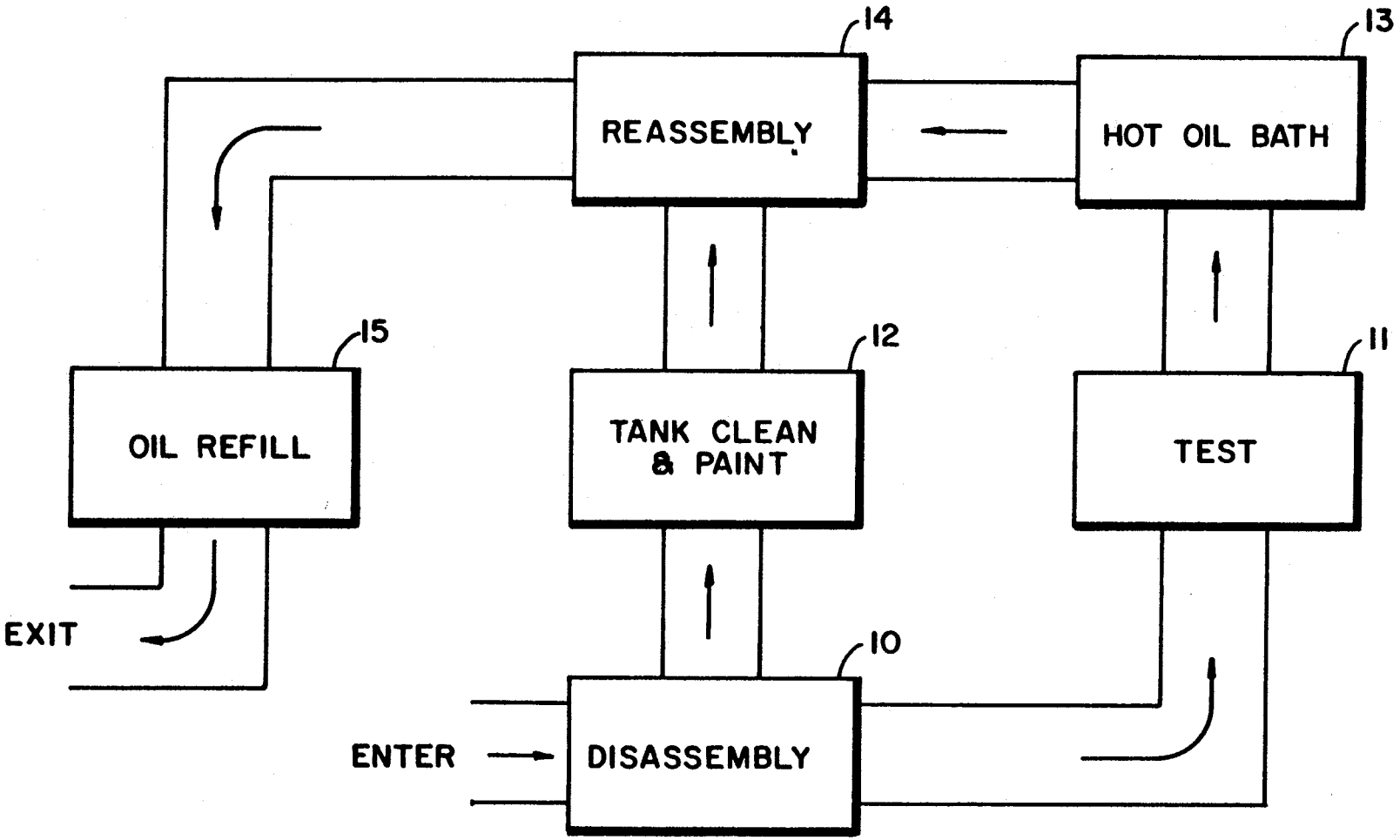
FIG. 1 is a flow diagram illustrating the various work stations and steps of the process of this invention.

FIG. 1 illustrates the flow, work stations and process steps of a preferred embodiment of the remanufacturing process of this invention. The incoming transformers are inserted into the flow at the location labelled "enter" and proceed to a disassembly station 10. At this station, the tank is drained of the oil and the transformer coil/core assembly is removed from the tank. The tank proceeds to work station 12 where it is cleaned and painted. The cleaned and painted tanks are then conveyed from work station 12 to work station 14 for reassembly.

The coil/core assemblies proceed from the disassembly station 10 to a test station 11. At station 11 the coil/-core assemblies are turns ratio tested and subjected to a core (no load) loss test.

If the coil/core assembly passes the station 11 tests, it is dispatched to station 13 where it is immersed in a hot oil bath for removal of contaminants. On the other hand, if the coil/core assembly fails the station 11 tests, the assembly is removed from the process flow illustrated in FIG. 1. The coil is then stripped from the core and a new coil is wound on the core. The newly wound coil/core assembly is then baked in an oven at a temperature and time adequate to cure the kraft paper epoxy. A typical bake time would be 8 to 10 hours at 275° F. After curing the newly wound coil core assemblies are then reinserted into the process flow of FIG. 1 at station 14 and reassembled. However, if the coil/core assembly has been allowed to reach ambient temperature, it will then be reinserted into the process flow of FIG. 1 to the hot oil bath station 13 so as to remove any moisture trapped in the kraft paper.

At station 13 the coil/core assemblies are immersed in a bath of hot mineral oil. The oil is heated to and maintained at a temperature (the process temperature) high enough to vaporize water but below the boiling temperature of the oil. Preferably, the bath oil is conventional transformer mineral oil, the same as used in the transformer tank for insulative and cooling purposes. Transformer mineral oil has a typical boiling temperature in the range of 290°-313° F. Accordingly, we prefer the oil bath process temperature for transformer mineral oil to be maintained in the range of 212° F. to 295° F. A typical transformer mineral oil is Univolt N61, available from Exxon Corporation.

When a coil/core assembly is dipped into the hot oil bath, the bath temperature will initially drop. This temperature drop will be sensed by a temperature control which will respond to reheat the bath to the desired process temperature in a manner described below. The coil/core assembly remains immersed for a resident time adequate (1) to allow the oil bath to reheat to the desired process temperature and (2) to expunge water, air and dirt from the assembly. This time is relatively short compared to the oven time for the hot air drying procedure. The following table summarizes the process times of differently sized coil/core assemblies for a desired process temperature of 250° F. (temperature tolerance of plus/minus 20° F.), where the process time is the time to expunge the contaminants and is measured from the point that the bath temperature has been reheated to the desired process temperature.

TABLE I

| Transformer Size (KVA) | Process Time (minutes) |
|---|---|
| 10-15 | 10 |
| 25-50 | 15 |
| 75-100 | 20 |
| 167-250 | 30 |
| 333-500 | 45 |

The process times in the above table are useful as guidelines as to the amount of hot oil bath time required to expunge the contaminants and serve to illustrate the considerable time savings vis-a-vis the 8 to 10 hour resident times required in the hot air drying procedure.

One way of measuring the effectiveness of the hot oil bath is to conduct a conventional power factor insulation test before and after dipping. This well known test may employ, for example, the ME 2500-Volt Portable Insulation Test Set, available from Doble Engineering Company, Watertown, Mass. Table II below shows the power factors before and after dipping for two exemplary transformer sizes and oil bath process temperatures.

TABLE II

| Transformer Size (KVA) | Time (min.) | Temp. (°F.) | Before | After |
|---|---|---|---|---|
| 15 | 10 | 250° | 1.7 | .40 |
| 25 | 15 | 260° | 6.7 | .80 |

We have found that the same approximate process times apply to the immersion or dipping of two or more transformers at a time into the oil bath, the process time being measured from the point in time that the oil bath is reheated (after the transformers enter the bath) to the desired process temperature.

The process times in Tables I and II are for single phase transformers. However, we contemplate that our invention is applicable as well to other transformer structures, including auto transformers and three-phase transformers with process times that will measure in minutes as compared to hours for the hot oven air drying procedure.

The rolling or boiling action of the hot oil causes a degree of coil/core cleaning that was not heretofore achieved with the hot air drying procedure. This boiling action tends to dislodge dirt and/or other solid particles from the coil/core assembly.

Upon removal from the hot oil bath, the coil/core assemblies proceed to station 14 for reassembly with the clean tanks. That is, a still hot contaminant free coil/core assembly is positioned within a clean tank and fastened and then moved on to station 15.

At station 15 the reassembled transformer tank is placed under a vacuum of less than one and one-half millimeters of mercury for a period of at least five minutes. Once this time has been exceeded, fresh transformer mineral oil is introduced into the tank until it is filled. The tank is then removed from the vacuum equipment and the remanufactured transformer exits the process flow.

Figure 2:
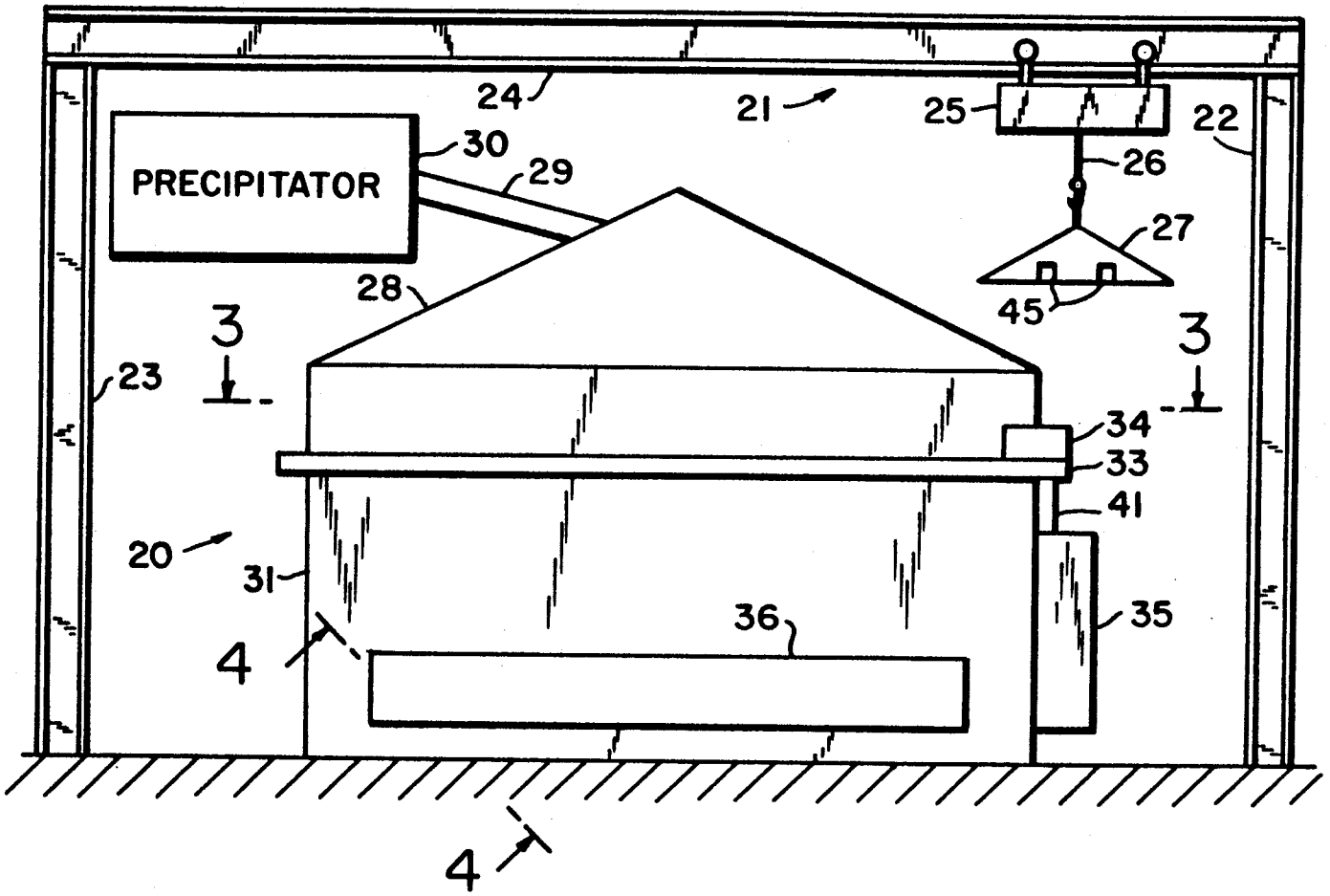
FIG. 2 is a side elevational view of the hot oil bath work station of FIG. 1.
Figure 3:
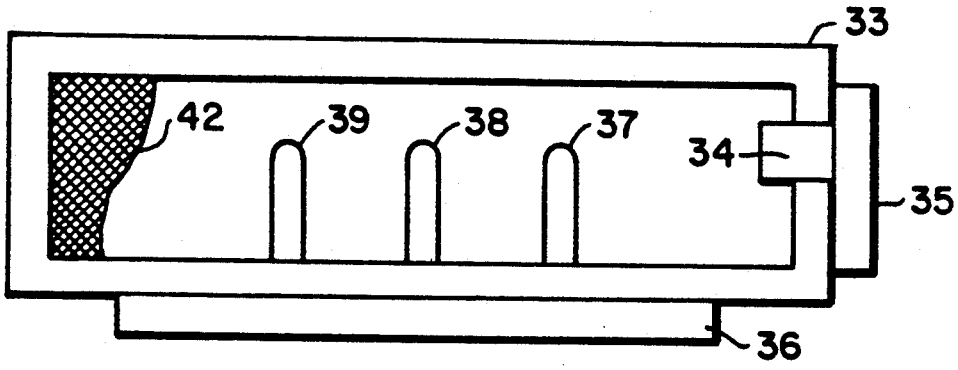
FIG. 3 is a top view of the hot oil bath tank of FIG. 2.
Figure 4:
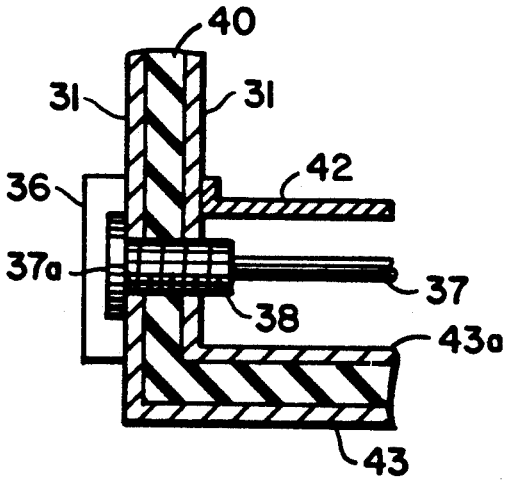
FIG. 4 is a cross sectional view taken along the lines 4—4 of FIG. 1, which has been enlarged to show the detail of the oil bath tank walls and manner of assembling heater elements thereto.

The hot oil bath station 13 in a preferred embodiment includes the equipment illustrated in FIGS. 2–4. Referring to these figures and, particularly, to the side elevational view of FIG. 2, the hot oil bath equipment includes a bath vessel 20 which has front, back and side walls together with a bottom. Only the front wall 31 is illustrated in FIGS. 2 and 4 and the bottom 43 is also shown in FIG. 4. These walls and the bottom are formed of metal (for example, 3/16 inch sheet steel) as by welding into a vessel or container that has a rectangular shape as seen by the top view of FIG. 3. In a preferred commercial embodiment of the invention, the vessel has an inside dimensional height of 48 inches, a width of 30 inches and a length of 72 inches. The bath vessel 20 is provided with a lip 33 which is arranged to collect oil drippings and return them to the tank.

Crane equipment 21 is provided to insert and remove the coil/core assemblies from the bath vessel 20. The crane equipment 21 includes a crane stand comprising spaced apart upright members 22 and 23 which are spanned at their upper extremities by cross beam 24. The crane equipment further includes a hoist 25 that is arranged for travel along the beam 24 together with a chain and hook assembly 26 that is arranged for up and down motion in the vertical direction. The travel of the hoist and the up and down motion of the chain and hook assembly are under the control of a control element which is not illustrated in FIG. 2. Typically, the hoist and chain and hook assembly may be a TECHSTAR 626, available from McMaster Supply Co.

The chain and hook assembly 26 may be used to insert the coil/core assemblies one at a time in which case, the hook may be latched onto the core. On the other hand, the coil/core assemblies may be loaded onto a basket 27 either one at a time or two or more at a time, two such coil/core assemblies 45 being so shown in FIG. 2. The chain and hook assembly is then latched onto the basket 27. The basket is lifted and the hoist positioned over the vessel 20 and basket lowered into the hot oil bath.

Associated with the bath vessel 20 is a hood 28, an exhaust 29 and a precipitator 30 which are arranged to trap and capture vapor which is emitted by the hot oil bath and contains the contaminants (water and other undesired substances). The precipitator 30 acts to separate the contaminants from the moisture for their separate disposal in a manner that is not harmful to the environment. The precipitator 30 may take the form of model SH 40 PES, available from United Air Specialists, Inc.

Positioned within the bath vessel 20 are electrical heaters 37, 38 and 39. These heaters are positioned near the bottom of the vessel in spaced apart relationship just beneath a heater protection element shown in FIGS. 3 and 4 as a wire mesh or grate 42.

A cover 35 is positioned along one side wall of the vessel 20 for the purpose of covering the controls for the heater elements 37, 38 and 39 as well as for a temperature probe (not shown) which is inserted into the oil bath. Covers 34 and 41 are also provided for the purpose of covering the temperature probe, while cover 36 is arranged to cover the electrical connections to the heater elements Preferably, the bath vessel walls and bottom are constructed of spaced apart outer and inner walls with the inner spacing being filled with a thermal insulator 40, such as glass fiber. This is best seen in FIG. 4 which is a partial and expanded cross sectional view of the front wall 31 and the bottom 43 as taken along the lines 4—4 of FIG. 2. Thus, front wall 31 forms an outer wall that is spaced from an inner wall **31*a* and the bottom 43 forms an outer bottom that is separated from an inner bottom 43*a*. The spacing between the inner and outer walls and the bottoms is filled with the thermal insulator 40**.

Also illustrated in FIG. 4 is the heater element 37 and a preferred implementation of its fixation to the bath vessel 20. In accordance with this implementation, a threaded pipe nipple 38 is inserted in a hole extending through the front wall structure of outer and inner walls 31 and **31*a* and the insulator 40. The heater element 37 is then inserted and threaded into the pipe nipple until the cap 37*a* rests against the outer front wall 31**.

Figure 5:
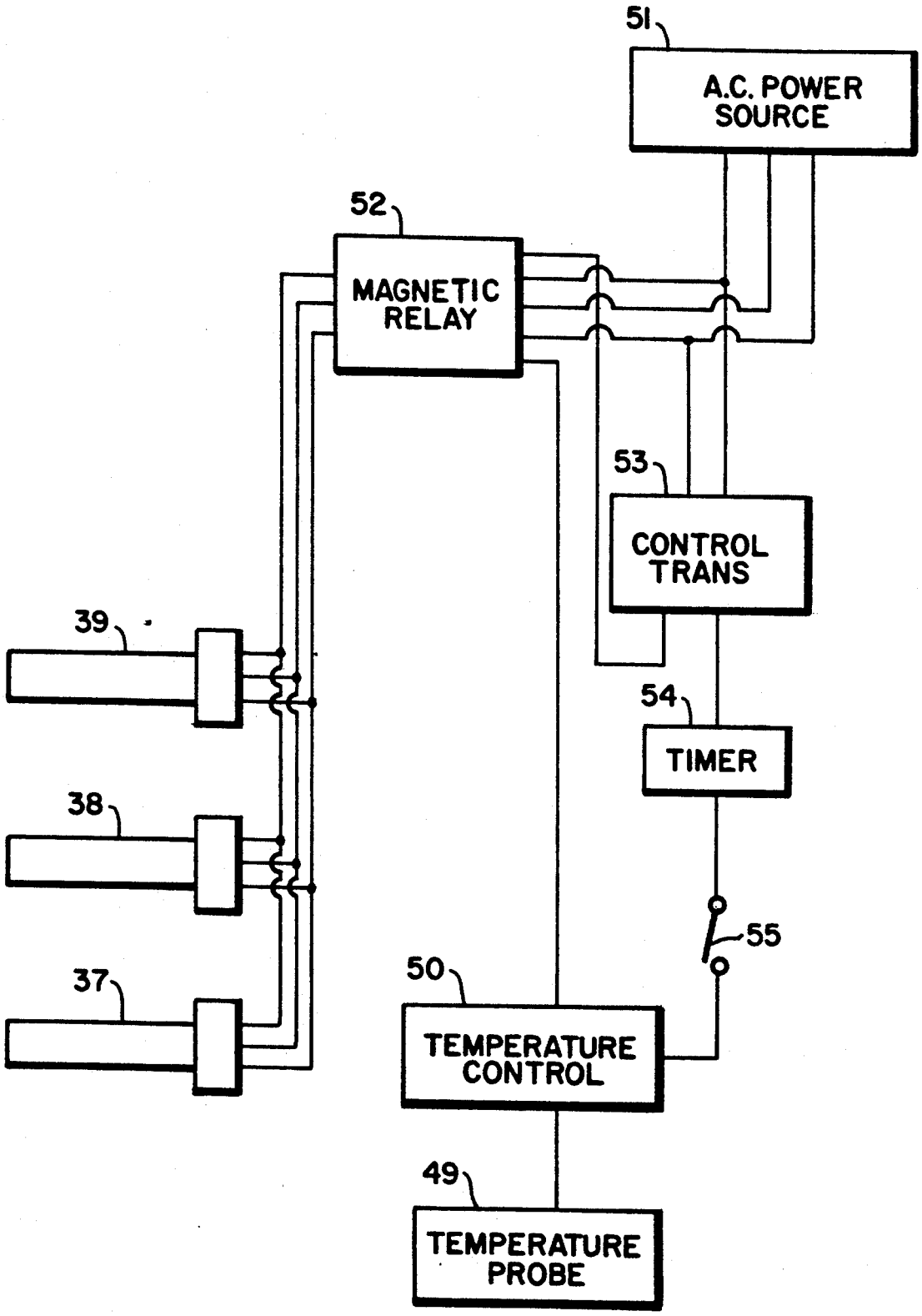
FIG. 5 is a block diagram of the electrical control for the heater system of the hot oil bath tank.

Referring now to the electrical block diagram of FIG. 5, the heater elements 37, 38 and 39 as well as the temperature probe 49 are under the control of a temperature control 50 to heat the mineral oil bath to and maintain a process temperature in the range of 212° F. to 295° F. These heater elements are rated for three phase 480 volts at 10,000 watts and may be model no. 3656K95, available from McMaster Carr Supply Co.

Three phase 480 volt A.C. power is applied from an a.c. power source 51 via a magnetic relay 52 to the heater elements 37, 38 and 39. Magnetic relay 52 is arranged to apply the 480 volt power to the heater elements 37, 38 and 39 until the oil bath temperature reaches the process temperature. When this happens, a temperature control responds to the temperature signal provided by temperature probe 49 to turn off the magnetic relay 52 and thereby disconnect the a.c. power from the heater elements. When the bath temperature subsequently falls below the process temperature, the temperature control 50 will respond by turning on relay 52 and thereby reconnecting the a.c. power to the heater elements 37, 38 and 39. This action will continue in a servo-type manner to maintain the temperature of the oil bath within a tolerance band of the desired process temperature.

A stepdown control transformer 53 translates the 480 volt A.C. power to 120 volt power for operation of the temperature control 50 and the magnetic relay 52. Connected in series with the control transformer 53 and the temperature control 50 is a timer 54 and a system on/off switch 55. The system on/off switch 55 is normally closed and is opened only for emergency or unusual conditions. The timer 54 is arranged to turn the system on and off at predetermined times each day. For instance, the timer 54 may turn the system off at the close of the workday and on a predetermined time before the start of the workday to assure that the oil bath is heated to the desired temperature by the time the work shift commences.

The temperature control 50 with probe 49, the magnetic relay 52 and the control transformer 53 may all be procured in a single package as model no. C-904, Heater Control With Transformer, available from HBS Equipment. The timer 54 may appropriately be model no. T 173, available from Intermatic Inc.

It is apparent from the above description that the process of the present invention is capable of removing contaminants from a transformer coil/core assembly in a matter of minutes as compared to hours for the prior art hot oven drying procedure. The process does this by employing a hot oil bath comprised of conventional grade transformer mineral oil and does not employ any hazardous materials. It should be apparent therefore that the method of this invention not only requires substantially less energy and time as well as avoids the use of hazardous materials.

Although a particular preferred embodiment of the invention has been disclosed in detail for illustrative purposes, it will be recognized that variations or modifications of the disclosed process lie within the scope of the present invention.

What is claimed is:

1. A method for the remanufacture of an electrical transformer having a coil/core assembly immersed in transformer mineral oil in a tank, wherein the assembly contains contaminants which include moisture, air and dirt; said process comprising:

removing said coil core assembly from the tank;

immersing the assembly in a bath of transformer mineral oil at a process temperature in the range of 212 deg. F. to 295 deg. F. for a process time of at least 10 minutes, such being adequate to expunge said contaminants from the assembly;

removing the assembly from the bath;

installing the assembly in a tank; and filling the tank of the preceding step with fresh mineral oil under vacuum conditions.

2. The method as set forth in claim 1 wherein a plurality of coil/core assemblies are simultaneously immersed in the bath during the same process time; and wherein said assemblies are simultaneously removed from the bath at the end of the process time.

3. The method as set forth in claim 1 wherein the process time is less than one hour.

4. The method as set forth in claim 1 which further includes the steps of:

sensing the temperature of the bath; and responsive to a temperature drop, heating the bath to the process temperature.

* * * * *